US005850127A

United States Patent [19]

Zhu et al.

[11] Patent Number: 5,850,127

[45] Date of Patent: Dec. 15, 1998

[54] EBL HAVING A FEEDBACK CIRCUIT AND A METHOD FOR ENSURING LOW TEMPERATURE LAMP OPERATION AT LOW DIMMING LEVELS

[75] Inventors: Joshua Zhu; Sreeraman Venkitasubrahmanian, both of Torrance, Calif.

[73] Assignee: Philips Electronics North America Corporation, New York, N.Y.

[21] Appl. No.: 644,094

[22] Filed: May 10, 1996

[51] Int. Cl.[6] ..... H05B 37/02

[52] U.S. Cl. ..... 315/307; 315/224; 315/DIG. 4

[58] Field of Search ..... 315/209 R, 224, 315/291, 307, DIG. 4, DIG. 7, 278

[56] References Cited

U.S. PATENT DOCUMENTS 3,989,976 11/1976 Tabor ..... 315/291

4,005,335 1/1977 Perper ..... 315/224

5,422,545 6/1995 Felper et al. ..... 315/209 R 5,583,402 12/1996 Moisin et al. ..... 315/307

*Primary Examiner*—Robert J. Pascal

*Assistant Examiner*—David H. Vu

*Attorney, Agent, or Firm*—Edward Blocker

[57] ABSTRACT

A dimming ballast lamp includes a lamp, a ballast circuit for converting AC input power to AC output power, a dimming interface circuit for generating a dimming control signal having a voltage level indicative of a selected dimming level of the lamp and a dimming circuit responsive to the dimming control signal for controlling operation of the ballast circuit. A feedback control circuit detects the lamp voltage and produces a feedback control signal in response to the lamp voltage exceeding a perscribed threshold voltage level. The dimming circuit, responsive to the feedback control signal, controls operation of the ballast circuit so as to increase lamp current thereby increasing the dimming level of the lamp, ensuring low temperature ignition of the lamp and protecting against lamp shutdown.

20 Claims, 1 Drawing Sheet

EBL HAVING A FEEDBACK CIRCUIT AND A METHOD FOR ENSURING LOW TEMPERATURE LAMP OPERATION AT LOW DIMMING LEVELS

BACKGROUND OF THE INVENTION

The present invention relates generally to dimmable electronic ballast and lamp systems, or simply, dimmable electronic ballast lamps (EBLs), and more particularly, to a feedback circuit for a dimmable EBL which ensures low temperature lamp ignition and operation at low dimming levels. The present invention also relates to a method for operating a dimmable EBL in such a manner as to ensure low temperature lamp ignition and operation at low dimming levels.

Electronic ballast lamps (EBLs) are in widespread use. In general, an EBL is a gas discharge lamp, e.g., a fluorescent lamp, which is coupled to an electronic ballast circuit which converts an AC line voltage into a high frequency sinusoidal lamp current for driving the lamp. In this connection, a typical EBL includes a 60 Hz filter/rectifier which filters and rectifies the AC power from a standard electrical outlet coupled to a 60 Hz utility line to produce a pulsating DC output, a DC-DC converter for converting the pulsating DC output produced by the rectifier to a smooth DC output having highly attenuated (i.e., low percent) ripple and an DC-AC inverter for inverting the smooth DC output from the DC-DC converter to a high frequency (e.g., 25–100 kHz) AC output. The typical EBL also includes an output transformer which transforms the AC output from the DC-AC inverter to produce the AC output power which is delivered to the lamp as a high frequency (e.g., 25–100 kHz) sinusoidal lamp current. The voltage applied to the lamp ignites the lamp by producing an electric discharge across opposite electrodes of the lamp. When the lamp is of the fluorescent type, the electric discharge ionizes mercury vapor contained within the glass tube or envelope of the lamp. The ionized mercury vapor emits ultraviolet radiation, that excites fluorescent material (phosphor) which is coated on the interior surface of the glass tube, which emits visible light. The typical EBL also includes a feedback control circuit which utilizes a lamp current or power feedback signal to modulate the duty cycle or switching frequency of the DC-AC inverter, to thereby regulate the sinusoidal lamp current/power.

Dimmable EBLs are also in widespread use. In general, a dimmable EBL further includes a dimming circuit for selectively varying the sinusoidal lamp current delivered to the lamp in order to thereby selectively vary the light output or brightness/dimming level (luminosity) of the lamp, e.g., over a range of 5%–100% of maximum light output. In this connection, a typical dimming circuit includes a dimming control interface circuit which produces a dimming control voltage proportional to the selected brightness/dimming level and a dimming control circuit which is responsive to the dimming control voltage for controlling the operation of the DC-AC inverter in such a manner as to adjust the AC output of the inverter to the appropriate level for driving the lamp to the selected brightness/dimming level. Of course, the brightness/dimming level can be selected by a user via a dimming control knob or slider, or other like user control device.

The output or lamp voltage produced by the output transformer of an EBL is inversely proportional to the lamp current, and is thus inversely proportional to the lamp output level (luminosity). At low temperature (e.g., ≦10° C.), most compact fluorescent lamps (and other types of dimmable EBLs) experience difficulty in maintaining adequate lamp current to ensure proper operation following ignition, especially when dimmed down to below 20% of the rated lamp current. Typically, when operating under these conditions, a dimmable EBL will shutoff due to insufficient lamp current to heat the lamp up to the level required to achieve successful operation following ignition, and the lamp voltage will be much higher than it would be under normal ambient temperature conditions, due to the increased load impedance which naturally occurs at lower temperatures and dimming levels. In certain types of dimmable EBLs, e.g., those having amalgam characteristics, this problem is even more pronounced.

At present, there is no known mechanism for overcoming the above-described major shortcoming of dimmable ballast lamp. Therefore, it can be readily appreciated that there presently exists a need in the art for a dimmable ballast lamp which overcomes this major shortcoming of presently available dimmable ballast lamps. In particular, there presently exists a need in the art for a dimmable ballast lamp which includes facilities for ensuring low temperature lamp ignition and operation at low dimming levels. The present invention fulfills this need.

SUMMARY OF THE INVENTION

The present invention encompasses a dimmable ballast lamp which includes a lamp, a dimming circuit for controllably adjusting the brightness level of the lamp to a selected level within a range between a minimum and a maximum brightness level, and a feedback control circuit for detecting a shutoff condition of the lamp and for producing a feedback control signal in response to detection of the shutoff condition, the dimming circuit being responsive to the feedback control signal for adjusting the brightness level of the lamp to a higher level than the selected level to thereby avoid the shutoff condition of the lamp.

The present invention further encompasses a dimmable ballast lamp which includes a lamp, a ballast circuit for converting AC input power to AC output power, a dimming interface circuit for generating a dimming control signal having a voltage level indicative of a selected dimming level of said lamp, a dimming circuit responsive to the dimming control signal for controlling operation of the ballast circuit in such a manner as to adjust the lamp current to a level proportionate to the voltage level of the dimming control signal, to thereby drive the lamp to the selected dimming level, and a feedback control circuit for detecting the lamp voltage and for producing a feedback control signal in response to the lamp voltage exceeding a prescribed threshold voltage level, the feedback control signal having a level proportional to an amount by which the lamp voltage exceeds the prescribed threshold voltage level. The dimming circuit is responsive to the feedback control signal for controlling operation of the ballast circuit in such a manner as to increase the lamp current, to thereby increase the dimming level of the lamp, the lamp current being increased sufficiently to ensure low temperature ignition of the lamp and to protect against lamp shutoff.

The present invention also embraces a method for operating a dimmable ballast lamp in such a manner as to protect against shutoff of the lamp, including the steps of detecting a shutoff condition of the lamp, producing a control signal in response to detection of the shutoff condition, and using the control signal to increase the brightness level of the lamp to a higher level. The shutoff condition preferably corresponds to an operating condition of the lamp in which an ambient temperature is below a prescribed temperature level and the brightness level is below a prescribed brightness level and/or to an operating condition of the lamp in which the lamp voltage exceeds a prescribed lamp voltage level. Preferably, the control signal has a voltage level which is proportionate to the amount by which the lamp voltage exceeds the prescribed lamp voltage level, to thereby increase the lamp current (and brightness level) to a level sufficient to eliminate lamp shutoff.

BRIEF DESCRIPTION OF THE DRAWING

These and various other features and advantages of the present invention will be readily understood with reference to the following detailed description taken in conjunction with the accompanying drawing, in which.

DETAILED DESCRIPTION OF THE INVENTION

Figure 1:
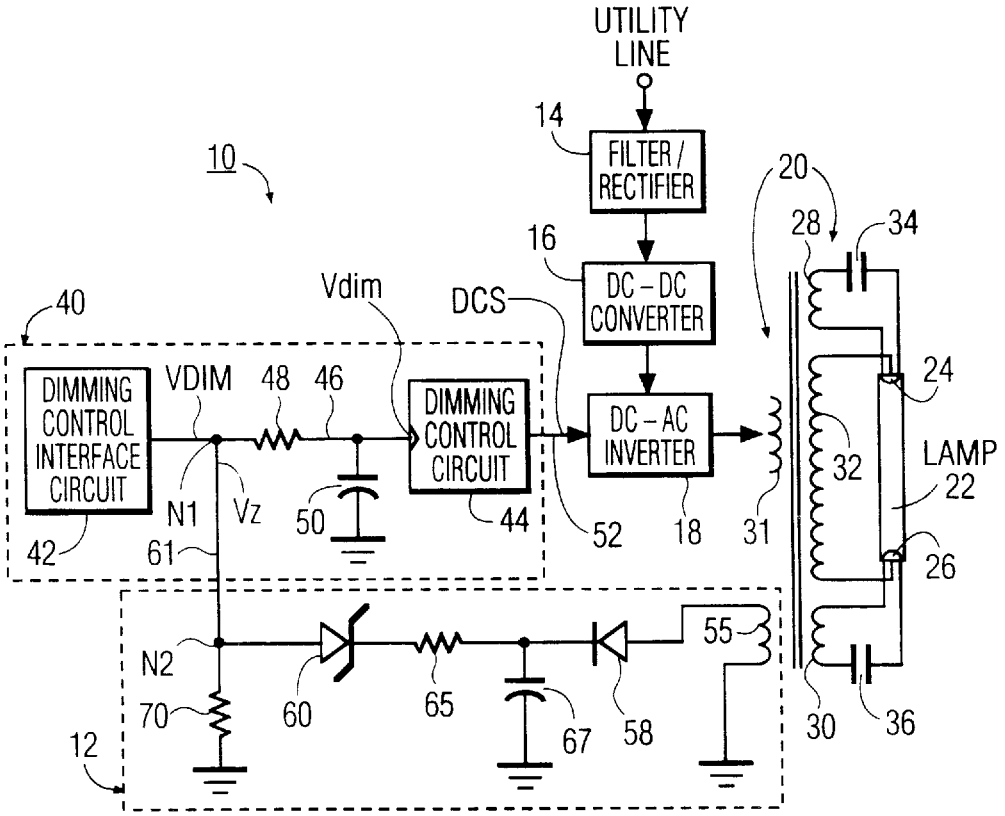
FIG. 1 is a partial schematic, partial block diagram of a dimmable EBL constructed in accordance with a preferred embodiment of the present invention.

With reference now to the FIG. 1, there can be seen a dimmable EBL 10 which constitutes a presently preferred embodiment of the present invention. As will be readily appreciated by those skilled in the pertinent art, the dimmable EBL 10 of the present invention is the same as the conventional dimmable EBL briefly described hereinabove, with the exception that the dimmable EBL 10 of the present invention further includes a novel feedback control circuit 12 which ensures low temperature lamp ignition and operation at low dimming levels in a manner which will become fully apparent hereinafter.

More particularly, the dimmable EBL 10 includes an EMI filter/rectifier 14, e.g., a half-bridge or full-bridge rectifier, which filters and rectifies the 60 Hz AC power from a utility line, and produces a pulsating DC output. The pulsating DC output from the rectifier 14 is smoothed out by a DC-DC converter 16, e.g., a high-frequency power factor correction (PFC) boost converter, which produces a smooth DC output with highly attenuated (i.e., low percent) ripple. The smooth DC output from the DC-DC converter 16 is then converted by a high-frequency DC-AC inverter 18 into a high-frequency (e.g., 25–100 kHz) AC output. The AC output from the DC-AC inverter 18 is coupled to the primary winding 31 of an output transformer 20, and is transformed by the output transformer 20 to produce AC output power of an appropriate level for igniting and operating a discharge lamp 22. The AC output power is delivered to the lamp 22 across opposite electrodes 24, 26 thereof, via filament windings 28, 30, respectively, coupled to the secondary winding 32 of the output transformer 20, to thereby produce a sinusoidal lamp current for igniting and operating the lamp 22. Current-limiting capacitors 34, 36 are provided in series with the filament windings 28, 30, respectively, to thereby properly adjust the heating current in accordance with the selected dimming level, and to prevent short circuits.

The dimmable EBL 10 further includes a dimming circuit 40 for controllably adjusting the brightness/dimming level (luminosity) of the lamp 22 to a selected level within a range between a minimum and maximum brightness level, e.g., between lamp output levels corresponding to 5% and 100% of maximum (rated) lamp current. The brightness/dimming level can be selected by a user via a dimming control knob (not shown) of either the rotating or sliding type, or other convenient user control device.

The dimming circuit 40 includes a dimming control interface circuit 42 which produces a dimming control signal VDIM having a voltage level which is proportional to the selected brightness/dimming level. For example, in the ballast portion of a compact fluorescent ballast lamp having amalgam characteristics and sold under the Philips brand name PL-T, the dimming control signal VDIM has a voltage range of 0.45V–2.85V, corresponding to a lamp brightness range of 5%–100% of maximum light output. Illustratively, the dimming control interface circuit 42 may include a rheostat or potentiometer (not shown) whose slider position is controlled by the selected setting (position) of the dimming control knob (e.g., as indicated on a user-interface dial), which corresponds to the selected brightness/dimming level.

The dimming circuit 40 further includes a dimming control circuit 44 which has a control input Vdim for receiving the dimming control signal VDIM over a line 46. A low-pass RC filter comprised of a resistor 48 and a capacitor 50 is interposed between the dimming control interface circuit 42 and the dimming control circuit 44 for low-pass filtering the dimming control signal VDIM applied over the line 46. The dimming control circuit 44 produces a dimming control signal DCS having a characteristic(s), e.g., voltage and/or frequency, which is proportional to the voltage level of the dimming control signal VDIM. In the above-mentioned PL-T compact fluorescent ballast lamp of the Philips Lighting Company, Somerset, N.J., the dimming control circuit 44 includes a voltage controlled oscillator (VCO) which is responsive to the voltage level of the dimming control signal VDIM for producing an output whose frequency is proportional to the voltage level of the dimming control signal VDIM.

The dimming control signal DCS is applied over a line 52 to an input of the DC-AC inverter 18 for controllably adjusting an operational characteristic thereof, e.g., the duty cycle or switching frequency thereof, to thereby adjust the AC output power to the appropriate level for driving the lamp 22 to the selected brightness/dimming level. Thus, in essence, the brightness/dimming level (light output level) of the lamp 22 is determined by the voltage applied to the control input Vdim of the dimming control circuit 44.

As previously mentioned, in accordance with the present invention, the dimmable EBL 10 further includes the feedback control circuit 12 which ensures low temperature lamp ignition at low dimming levels. More particularly, the feedback control circuit 12 preferably includes a feedback winding 55 on the primary side of the output transformer 20. The feedback voltage Vfb on the feedback winding 55 is proportional to the voltage on the secondary winding 32 of the output transformer 20, and thus, is proportional to the lamp voltage (i.e., the voltage applied across the lamp electrodes to drive the lamp).

The operation of the feedback control circuit 12 is premised upon the fact that the level of the feedback voltage Vfb increases in a predictable manner in response to a low temperature/low dimming level condition of the lamp 22 which causes the lamp 22 to extinguish (shutoff). In this connection, with the PL-T compact fluorescent ballast lamp of the Philips Lighting Company, at low dimming levels (e.g., $\leqq$20% of the maximum lamp brightness level), the lamp voltage will be significantly higher (e.g., 10%–30%$^{+}$ higher) at low ambient temperatures (e.g $\leqq$10° C.) than the lamp voltage will be at normal ambient temperatures (referred to as nominal lamp voltage), and thus, the feedback voltage Vfb will also be 10%–30% higher than the nominal feedback voltage Vfbn (i.e., the feedback voltage at normal ambient temperatures). In particular, with the PL-T compact fluorescent lamp, when the lamp voltage exceeds 130% nominal lamp voltage, the lamp will extinguish (shutoff).

Thus, the present invention is based upon the realization that it is possible to detect such a "shutoff condition" of the lamp 22 by detecting (sensing) using the feedback winding 55 (or other convenient feedback mechanism) to detect the relative level of the lamp voltage (i.e., to develop the feedback voltage Vfb which is proportional to the lamp voltage). As used hereinthroughout the specification and claims, the terminology "shutoff condition" shall mean a low temperature/low dimming level operating condition of the lamp 22 which corresponds to the lamp 22 actually being shutoff, or being near (e.g., within 10%) of the actual shutoff point.

The feedback control circuit 12 further includes a peak detector comprised of a forward-biased diode 58 and a capacitor 67, a resistor 65 and a zener diode 60 connected in series between the peak detector and a line 61, and a resistor 70 connected between ground and a node N1 formed at the junction of the lines 46 and 61. The anode of the zener diode 60 is connected to a node N2 intermediate the node N1 and the resistor 70. Preferably, the breakdown voltage Vbd of the zener diode 60 is set to be equal to a predetermined threshold level of the feedback voltage Vfb which is indicative of a shutoff condition of the lamp 22. Thus, when a shutoff condition of the lamp 22 occurs, a voltage Vz will be developed across the zener diode 60 which is proportional to the amount by which the detected feedback voltage Vfb exceeds the preset zener breakdown voltage Vbd. More particularly, the voltage Vz will have a value defined by the following equation (1):

$$Vz=(Vfb-Vbd)*R70/(R65+R70),\ \text{when } Vfb>Vbd,\ (Vz=0 \text{ otherwise}), \quad (1)$$

where R70 represents the resistance value of resistor 70, and R65 represents the resistance value of resistor 65.

The voltage Vz will hereinafter be referred to as the "feedback control voltage", since it is fed back via the lines 46 and 61 to the control input Vdim of the dimming control circuit 44, to thereby pull up (raise) both the voltage applied to control input Vdim and the operating point of the dimming control circuit 44 accordingly. In essence, the feedback control circuit 12 functions to generate a feedback control voltage Vz which is proportional to the amount by which the lamp voltage exceeds a prescribed threshold level. A rise in the operating level of the dimming control circuit 44 results. The dimming level of the lamp 22 therefore rises by an amount appropriate to ensure that the lamp 22 receives sufficient lamp current to heat the lamp 22 to a level sufficiently high to ensure low temperature lamp ignition and to protect against lamp shutoff.

For example, in a presently contemplated embodiment of the present invention, the breakdown voltage Vbd of the zener diode 60 is set to 1.1 Vfbn, so that if the feedback voltage Vfb rises to a level greater than 110% of the nominal feedback voltage Vfbn (i.e., to 1.1 Vfbn), a feedback control voltage Vz will be developed which is proportional to the amount by which the detected feedback voltage Vfb exceeds the preset zener breakdown voltage Vbd. More particularly, in the presently contemplated embodiment of the present invention, using a PL-T compact fluorescent ballast lamp of the Philips Lighting Company, the values of the resistors 65 and 70 and the value of the lamp voltage such that if the lamp voltage is 130% of the nominal lamp voltage, and thus, the detected feedback voltage Vfb is 130% greater than the nominal feedback voltage Vfbn (i.e., Vfb=1.3 Vfbn), then the feedback control voltage Vz will have a value of (1.3 Vfbn−1.1 Vfbn)*(R70/(R65+R70))=1.5 V. When the voltage range of the control input Vdiin is 0.45 V–2.85 V, corresponding to a dimming level range of 5%–100% of maximum brightness level of the lamp 22, then the dimming level will be raised from a low dimming level of below 20% of maximum brightness level to a higher dimming level of about 40% of maximum brightness level.

It will be readily understood that under normal ambient temperature conditions of the lamp 22, the feedback voltage Vfb will be Vfbn, and thus, the feedback control voltage Vz will be effectively 0V (i.e., the zener diode 60 will appear to be a virtually infinite impedance), so that the level of the control input Vdim will be directly governed by the dimming control signal VDIM supplied by the dimming control interface circuit 42, and thus, the dimming level of the lamp 22 will be determined by the level of the dimming control signal VDIM, which corresponds to the selected dimming level.

It will also be readily understood that when a shutoff condition of the lamp 22 occurs (i.e., a low temperature/low dimming level condition which results in actual or near-actual lamp shutoff), the actual lamp voltage will be at least 110% greater than the nominal (normal ambient) lamp voltage. Thus, the detected feedback voltage Vfb will be at least 110% greater than the nominal (normal ambient) feedback voltage Vfbn, thereby causing a feedback control voltage Vz to be developed which is proportional to the amount by which Vfb exceeds Vfbn, thereby ultimately resulting in the dimming level of the lamp 22 (and thus, the lamp current) being raised by an amount proportional to the feedback control voltage Vz, thus protecting against lamp shutoff Although a presently preferred embodiment of the present invention has been described in detail hereinabove, it should be clearly understood that many variations and/or modifications of the basic inventive concepts herein taught which may appear to those skilled in the pertinent art will fall within the spirit and scope of the present invention as defined in the appended claims. For example, the particular threshold setting which is selected for generating the feedback control voltage is not limiting to the present invention. Further, the actual feedback control circuitry which is employed in the practice of the present invention is not limiting to the present invention, so long as a feedback control signal which is proportional to (or otherwise related to) the amount by which the lamp voltage exceeds some prescribed threshold level indicative of a lamp shutoff condition is generated, and so long as this feedback control signal is utilized to raise the dimming level (i.e., lamp current) to a level sufficient to protect against lamp shutoff.

What is claimed is:

1. A dimmable ballast lamp, including:

a lamp;

a ballast circuit including an inverter coupled to and for powering the lamp and having in response to a dimming control signal at least one adjustable operational characteristic selected from the group of duty cycle and switching frequency;

a dimming circuit coupled to the inverter for producing said dimming control signal in response to a control input signal which is based when avoiding a shutoff condition of said lamp on a first precontrol input signal being raised by addition thereto of a second precontrol input signal;

a dimming control interface for producing said first precontrol input signal based on a selected brightness level; and a feedback control circuit for detecting the shutoff condition of said lamp and for producing said second precontrol input signal in response to detection of said shutoff condition, said dimming circuit being responsive to said first precontrol input signal and to said second precontrol input signal for adjusting the brightness of said lamp to a higher brightness level than said selected brightness level independent of the ballast circuit impedance to thereby avoid the shutoff condition of said lamp.

2. The dimmable ballast lamp as set forth in claim 1, wherein said feedback control circuit includes first facilities for generating a lamp voltage feedback signal having a voltage level proportional to a lamp voltage applied to said lamp.

3. The dimmable ballast lamp as set forth in claim 2, wherein said feedback control circuit includes second facilities responsive to said lamp voltage feedback signal for generating said second precontrol signal when the voltage level of said lamp voltage feedback signal exceeds a prescribed threshold voltage level.

4. The dimmable ballast lamp as set forth in claim 3, further comprising:

conversion circuitry for converting AC input power to DC output power;

said inverter for inverting said DC output power into AC output power, said AC output power having a voltage level which is inversely proportional to a current level of said AC output power;

an output stage for delivering said AC output power to said lamp;

wherein said dimming circuit includes facilities responsive to said second precontrol input signal for generating a dimming control signal having a characteristic which is proportional to said second precontrol input signal; and, wherein said inverter is responsive to said dimming control signal for increasing said current level of said AC output power.

5. The dimmable ballast lamp as set forth in claim 4, wherein:

said output stage includes a transformer having a primary winding coupled to said AC output power and a secondary winding coupled to said lamp; and, said first facilities of said feedback control circuit includes a feedback winding provided on a primary side of said transformer.

6. The dimmable ballast lamp as set forth in claim 5, wherein said second facilities of said feedback control circuit includes a zener diode having a prescribed breakdown voltage which is equal to said prescribed threshold voltage level.

7. The dimmable ballast lamp as set forth in claim 6, wherein said prescribed threshold voltage level is a prescribed amount greater than the voltage level of said lamp voltage feedback signal when said lamp is operated at a temperature within a normal ambient temperature range.

8. The dimmable ballast lamp as set forth in claim 1, wherein said second precontrol input signal has a voltage level proportional to an amount by which a lamp voltage applied to said lamp exceeds a prescribed threshold voltage level.

9. The dimmable ballast lamp as set forth in claim 8, wherein said shutoff condition comprises an operating condition of said lamp in which an ambient temperature is below a perscribed temperature level and the brightness of said lamp is below a perscribed brightness level.

10. The dimmable ballast lamp as set forth in claim 1, wherein said shoutoff condition comprises an operating condition of said lamp in which an ambient temperature is below a perscribed temperature level and the brightness of said lamp is below a perscribed brightness level.

11. The dimmable ballast lamp as set forth in claim 1, wherein said said shutoff condition comprises an operating condition of said lamp in which a voltage applied to said lamp exceeds a prescribed threshold voltage level.

12. A dimmable ballast lamp, including:

a lamp;

a ballast circuit for converting AC input power to AC output power and for delivering said AC output power to said lamp to produce a lamp voltage and a lamp current;

a dimming dimming interface circuit for generating a dimming control signal having a voltage level indicative of a selected dimming level of said lamp;

a dimming circuit responsive to said dimming control signal for controlling operation of said ballast circuit in such a manner as to adjust said lamp current to a level proporational to the voltage level of said dimming control signal, to thereby drive said lamp to said selected dimming level;

a feedback control circuit for detecting said lamp voltage and for producing a feedback control signal in response to said lamp voltage exceeding a perscribed threshold voltage level, said feedback control signal having a voltage exceeds said perscribed threshold voltage level; and, wherein said dimming circuit is responsive to said dimming control signal being raised by addition thereto of said feedback control signal for controlling operation of said ballast circuit in such a manner as to increase said lamp current, to thereby increase the dimming level of said lamp.

13. The dimmable ballast lamp as set forth in claim 12, wherein said prescribed threshold voltage level corresponds to an operating condition of said lamp in which an ambient temperature is below a prescribed temperature level and said dimming level of said lamp is below a prescribed dimming level.

14. The dimmable ballast lamp as set forth in claim 12, wherein said feedback control circuit includes:

first means for detecting the level of said lamp voltage and for generating a lamp voltage feedback signal having a voltage level proportional to said lamp voltage; and, second means for detecting when the voltage level of said lamp voltage feedback signal exceeds a prescribed lamp voltage threshold level and for generating said feedback control signal upon detection that the voltage level of said lamp voltage feedback signal exceeds said lamp voltage threshold level.

15. The dimmable ballast lamp as set forth in claim 14, wherein said dimming circuit is responsive to said feedback control signal for controlling operation of said ballast circuit in such a manner as to increase said sinusoidal lamp current by an amount proportional to the voltage level of said feedback control signal, to thereby increase said dimming level to a level proportional to the voltage level of said feedback control signal.

16. The dimmable ballast lamp as set forth in claim 15, wherein said prescribed lamp voltage threshold level is a prescribed amount greater than the voltage level of said lamp voltage feedback signal when said lamp is operated at a temperature within a normal ambient temperature range.

17. A method for operating a dimmable ballast lamp in such a manner as to protect against shutoff of the lamp, comprising the steps of:

generating a dim signal representing a desired brightness:

detecting a shutoff condition of the lamp;

producing a control signal in response to detection of said shutoff condition; and, using said control signal to increase the level of the dim signal such that the desired brightness of the lamp is increased to a higher level and the shutoff condition is avoided.

18. The method as set forth in claim 17, wherein said shutoff condition of the lamp comprises an operating condition of the lamp in which an ambient temperature is below a prescribed temperature level and the brightness level of the lamp is below a prescribed brightness level.

19. The method as set forth in claim 17, wherein the step of detecting said shutoff condition includes the sub-steps of:

detecting a voltage level of the lamp;

producing a lamp voltage feedback signal proportional to the detected voltage level of the lamp; and, detecting when a voltage level of said lamp voltage feedback signal exceeds a prescribed lamp voltage threshold level; and, wherein the step of producing the control signal is carried out by producing said control signal in response to detecting that the voltage level of said lamp voltage feedback signal exceeds said prescribed lamp voltage threshold level, the voltage level of said control signal being proportional to an amount by which the voltage level of said lamp voltage feedback signal exceeds said prescribed lamp voltage threshold level.

20. The method as set forth in claim 19, wherein said prescribed lamp voltage threshold level is a prescribed amount greater than the voltage level of said lamp voltage feedback signal when the lamp is operated at a temperature within a normal ambient temperature range.

* * * * *